United States Patent [19]

Masso et al.

[11] Patent Number: 4,478,873

[45] Date of Patent: Oct. 23, 1984

[54] METHOD IMPARTING ANTI-STATIC, ANTI-REFLECTIVE PROPERTIES TO OPHTHALMIC LENSES

[75] Inventors: Jon D. Masso, Whitinsville, Mass.; William D. Brennan, Woodstock, Conn.; Don H. Rotenberg, Westboro, Mass.

[73] Assignee: American Optical Corporation, Southbridge, Mass.

[21] Appl. No.: 497,264

[22] Filed: May 23, 1983

[51] Int. Cl.[3] ..... B05D 3/06

[52] U.S. Cl. ..... 427/40; 427/41; 427/164

[58] Field of Search ..... 427/40, 41, 164

[56] References Cited

U.S. PATENT DOCUMENTS

| | | | |
|---|---|---|---|
| 2,432,484 | 12/1947 | Moulton | 88/1 |
| 2,474,061 | 6/1949 | Moulton | 88/1 |
| 2,482,684 | 9/1949 | Moulton | 106/287 |
| 2,531,945 | 11/1950 | Moulton | 88/1 |
| 2,536,764 | 1/1951 | Moulton | 117/27 |
| 2,584,905 | 2/1952 | Moulton et al. | 106/287 |
| 2,601,123 | 6/1952 | Moulton | 106/287 |
| 3,389,012 | 6/1968 | Hamm | 117/38 |
| 3,471,316 | 10/1969 | Manuel | 117/93.3 |
| 3,475,307 | 10/1969 | Knox et al. | 204/168 |
| 3,526,583 | 9/1970 | Hayward | 204/165 |
| 3,600,122 | 8/1971 | Coleman | 8/115.7 |
| 3,687,832 | 8/1972 | Fydelor et al. | 204/165 |
| 3,986,997 | 10/1976 | Clark | 260/29.2 |
| 4,114,983 | 9/1978 | Maffitt et al. | 350/164 |
| 4,137,365 | 1/1979 | Fletcher et al. | 428/412 |
| 4,140,607 | 2/1979 | Kreiselmeier et al. | 204/168 |
| 4,168,113 | 9/1979 | Chang et al. | 351/166 |
| 4,172,156 | 10/1979 | Ritter et al. | 427/38 |
| 4,211,823 | 7/1980 | Suzuki et al. | 428/412 |
| 4,276,138 | 6/1981 | Asai et al. | 204/165 |

FOREIGN PATENT DOCUMENTS 1501243 9/1974 United Kingdom .

OTHER PUBLICATIONS

P. B. Clapham et al., "Reduction of Lens Reflexion by the Moth Eye Principle", Nature, vol. 244, Aug. 3, 1973.

E. Spiller et al., "Graded-Index AR Surfaces Produced by Ion Implantation on Plastic Materials", Applied Optics, vol. 19, No. 17, Sep. 1, 1980.

*Primary Examiner*—Bernard D. Pianalto

*Attorney, Agent, or Firm*—Kenway & Jenney

[57] ABSTRACT

Novel anti-static and/or anti-reflective optical elements are produced by coating at least one surface of an organic polymeric plastic substrate with a protective organo-silica coating composition and then subjecting the coated plastic substrate to a glow discharge treatment.

28 Claims, 1 Drawing Figure

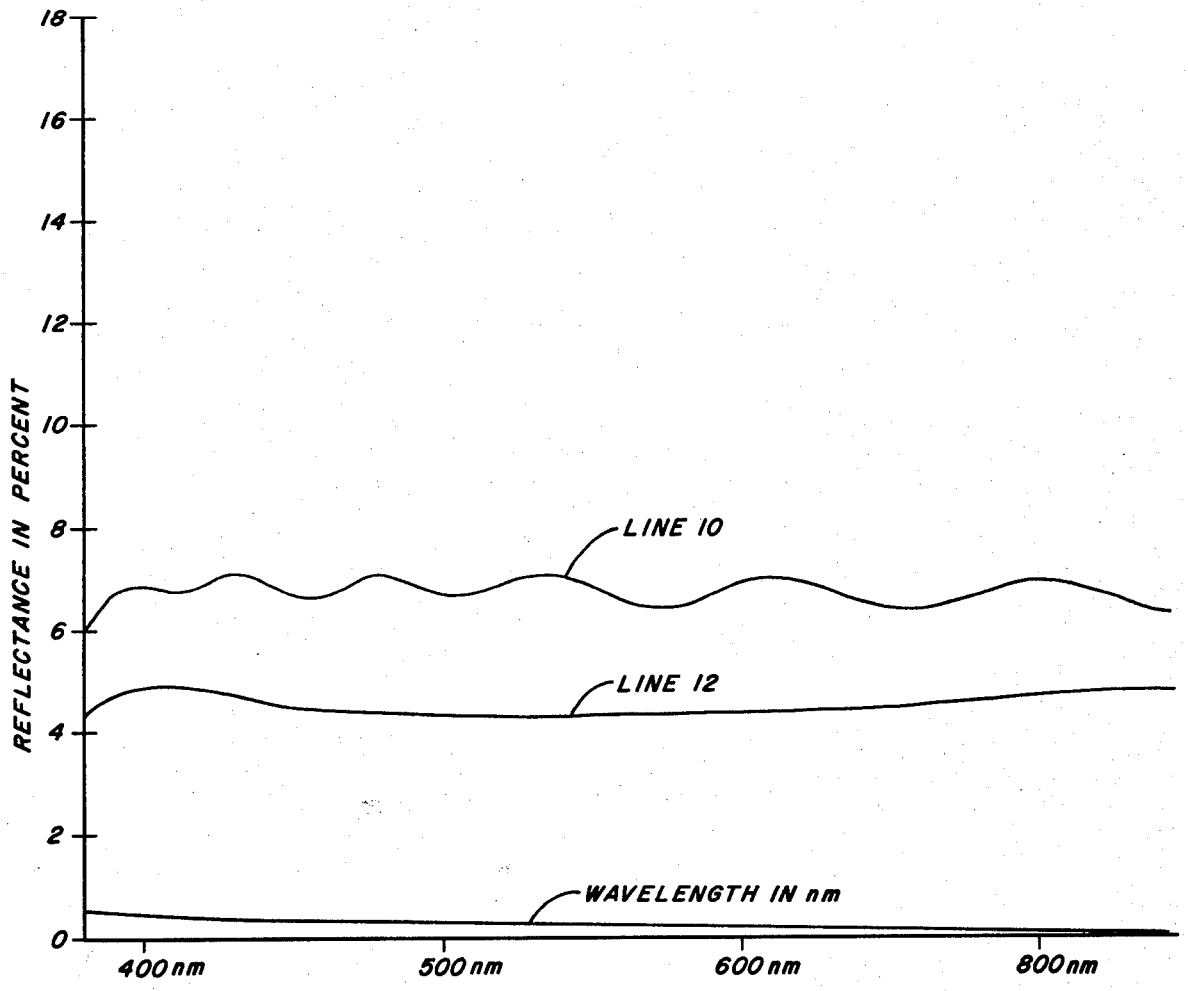
18
16
14
12
10
8
6
4
2
0
REFLECTANCE IN PERCENT
LINE 10
LINE 12
WAVELENGTH IN nm
400nm
500nm
600nm
800nm

METHOD IMPARTING ANTI-STATIC, ANTI-REFLECTIVE PROPERTIES TO OPHTHALMIC LENSES

BACKGROUND OF THE INVENTION

This invention relates to methods of coating optical surfaces and in particular, to a new and useful process for coating an ophthalmic lens so that the finished lens has an anti-static and/or anti-reflective surface.

The build-up of static charge on plastic elements (especially plastic ophthalmic lenses coated with organo-silica based abrasion-resistant coatings, i.e. silica-polyorganosiloxane or polyorganosiloxane) attracts dust and is unacceptable in many applications (e.g., polycarbonate safety lenses in steel mills, cotton mills and coal mines). In the case of eyewear, these dust particles cause light scattering or haze which can severely limit the visual acuity of the wearer and necessitates frequent cleaning.

Certain topical treatments are commercially available for the prevention of static charge build-up, but these topical treatments are short lived and must be continually repeated.

Another way of preventing the build-up of static charge on plastic lenses is to imbibe anti-static agents into the plastic materials. However, these anti-static agents are known eye irritants and may not be suitable for ophthalmic purposes. Furthermore, these anti-static agents are designed to migrate to the surface where they can interfere with the coating/substrate interface.

It is also often desirable in many applications to reduce the reflectance of an optical surface. By reducing the reflectance of light impinging upon the surface of an optical element, a greater percentage of incident light will be transmitted through the optical element.

When optical elements are molded out of a polymeric plastic substrate, the reflectance is commonly reduced by vacuum deposition of single or multiple film layers which are designed and fabricated to reduce reflectance by interference effects. These layers require a high level of skill and complex equipment to manufacture on a large scale. Also, when some of these coatings are exposed to moist or otherwise hostile environments, they will deteriorate rapidly. Specifically, unless care is taken in the design and construction of such coatings, exposure to hostile environments may reduce the adherence of the coating to the substrate and the coating may be peeled or otherwise separated from the optical element.

There has been considerable use in recent years of an electrical discharge in order to form flexible thin films of solid organic material upon the surface of a substrate. Thin electrical discharge may be maintained in the sparking, corona or glow region, of an electrical phenomenon.

A glow discharge may be defined as a silent discharge without sparks and having a space potential gradient in the vicinity of the cathode resulting in a potential difference near the cathode which is considerably higher than the ionization potential of the surrounding gas. Typical structure of the glow discharge is identified by a steep potential gradient at the cathode and operating primarily by electron liberation by positive ion bombardment at the cathode. In relation to a corona discharge, a glow discharge is characterized by a much lower potential or voltage and a higher current than a corona discharge. Unlike a corona discharge which is a reversible discharge situation, the glow discharge occurs after the sparking or breakdown potential is exceeded and is an irreversible change which has occurred in the electrical circuit.

Accordingly, it is a principal object of the present invention to reduce the reflectance of and to prevent the buildup of static charge on the surfaces of an optical element.

It is another object of the invention to reduce the reflectance of and to prevent the build-up of static charge on the surface of plastic ophthalmic lenses coated with abrasion-resistant coatings.

It is a further object of the invention to reduce the reflectance of the surfaces of an optical element without causing any coatings on the optical element to peel or otherwise separate from the optical element.

SUMMARY OF THE INVENTION

The problems of the prior art are overcome by the discovery that novel anti-static and/or anti-reflective optical elements can be produced by coating at least one surface of an organic polymeric plastic substrate with a protective organo-silica coating composition and then subjecting the coated plastic substrate to a glow discharge treatment.

Although ophthalmic lenses are the preferred optical elements of the invention, other optical elements of the invention may include solar panels, instrument covers and CRT display devices.

BRIEF DESCRIPTION OF THE DRAWING

The sole FIGURE of the drawing is a graph illustrating the reflectance of an organo-silica coated CR-39 TM lens before and after a glow discharge treatment.

DETAILED DESCRIPTION OF THE PREFERRED EMBODIMENT

In accordance wtih the present invention, there is provided an optical element molded from an organic polymeric plastic substrate. At least one surface of the plastic substrate is coated with a protective organo-silica coating composition. The coated plastic substrate is then exposed to a vacuum glow discharge.

Any type of organic polymeric plastic substrate may be used, i.e., a polycarbonate substrate, more specifically a poly (2,2'-dihydroxyphenylpropane)carbonate substrate; an allyl substrate, more specifically a CR-39 TM substrate; or an acrylic substrate, more specifically polymethyl methacrylate. CR-39 TM is a polydiethylene glycol bis (allyl carbonate) obtained from PPG Industries, Inc.

The organo-silica coating composition may comprise, for example, the silica-polyorganosiloxane coating composition disclosed in U.S. Pat. No. 3,986,997 (Clark), or the silica-polyorganosiloxane coating disclosed in U.S. Pat. No. 4,211,823 (Suzuki et al), the disclosures of which are incorporated herein by reference.

The Suzuki et al coating is the preferred organo-silica coating in the invention. This coating not only is tintable and known to have excellent adherence even in hostile environments, but when the surfaces of an optical element of the invention are coated with this composition and then subjected to a glow discharge, the surfaces of the optical element become both anti-static and anti-reflective. The drawing illustrates the reflectance of a CR-39 TM monomer based lens with this coating before and after a glow discharge treatment. Line 10 represents the reflectance of such a coated lens before being subjected to a glow discharge treatment, and line 12 represents the lower reflectance of the Suzuki et al coated lens after being subjected to a glow discharge treatment. This Suzuki et al coating composition includes (A) (1) hydrolysates of silane compounds containing at least one epoxy group and not less than two alkoxy groups which are directly bonded to Si atom in the molecule, and if necessary, (2) compounds containing silanol and/or siloxane groups in the molecule, and/or epoxy compounds; (B) fine silica particles having an average diameter of from about 1 to about 100 mu; (C) an aluminum chelate compound having the general formula $AlX_nY_{3-n}$, where X is OL (and L represents a lower alkyl group), Y represents one or more ligands produced from a compound selected from the group consisting of $M^1COCH_2COM^2$ and $M^3COCH_2COOM^4$ where all of $M^1$, $M^2$, $M^3$ and $M^4$ are lower alkyl groups and wherein n is an integer comprising 0, 1 or 2; and (D) a solvent comprising more than about 1 weight percent water, the amount of component B being about 1 to 500 parts by weight per 100 parts by weight of component A, and the amount of component C being about 0.01 to 50 parts by weight per 100 parts by weight of component A.

The Clark organo-silica coating is an aqueous coating composition comprising a dispersion of colloidal silica in lower aliphatic alcohol-water solution of the partial condensate of a silanol of the formula $RSi(OH)_3$ in which R is selected from the group consisting of alkyl radicals of 1 to 3 inclusive carbon atoms, the vinyl radical, the 3,3,3-trifluoropropyl radical, the gamma-glycidoxypropyl radical and the gamma-methacryloxypropyl radical, at least 70 weight percent of the silanol being $CH_3Si(OH)_3$, said composition containing 10 to 50 weight percent solids consisting essentially of 10 to 70 weight percent colloidal silica and 30 to 90 weight percent of the parital condensate, said composition containing sufficient acid to provide a pH in the range of 3.0 to 6.0. When the surfaces of an optical element of the invention are coated with this composition and then subjected to a glow discharge, the surfaces of the optical element do not become anti-reflective, but they do become quite anti-static.

As for the specifics of the glow discharge treatment, it was found that the method of producing the plasma was not important since DC, AC (60 Hz) and RF plasmas all proved to be effective. The gas pressure was also found to be unimportant as any pressure capable of sustaining a plasma produced the desired results. Of course, there may be an optimum pressure and power (voltage and current) in case one wished to minimize the time required for the glow discharge treatment. For example, the time required for producing a surface with a lowered reflectance was found to be dependent on the power supplied. In the RF glow discharge, five minutes was sufficient, while with the DC glow discharge, times ranging from 5 to 15 minutes were required.

The one factor of the glow discharge treatment which did seem to make a difference, especially in providing an anti-reflective surface, was the type of gas used. Although oxygen, air, helium and nitrogen all produced anti-static surfaces on both the Suzuki et al and Clark coatings, only gases containing oxygen (i.e., $O_2$, air and a mixture of $O_2$ and $CF_4$ were effective in producing an anti-reflective surface and only on Suzuki et al coatings.

The invention is further illustrated by the following non-limiting examples.

EXAMPLE 1

An optical element coated with the Suzuki et al coating composition was subjected to a DC glow discharge in oxygen at a pressure of 0.075 Torr, at a voltage of 300 VDC and at a current between 250 to 300 mA for 10 minutes. The optical element resulting from this process had an anti-reflective surface as well as an anti-static surface. Reflectance dropped from 6.5 percent before the glow discharge treatment to an average visual reflectance of 2 percent after.

EXAMPLE 2

Both sides of a Suzuki et al coated CR-39 TM lens were exposed to a DC glow discharge in air for 15 minutes at a pressure of 0.07 Torr, at a current of 300 mA, and at a voltage of −300 VDC at a distance of about 5 cm from the cathode with the surface of the lens being parallel to that of the cathode. The charge decay rate (the time for initial surface charge created by a corona discharge to decay to 10 percent of its original value) was 17 minutes prior to the glow discharge exposure and less than 1 second after the exposure. As seen in the drawing, reflectance dropped to 6.8 percent before the treatment to an average visual reflectance of 4.2 percent after.

EXAMPLE 3

An optical element coated with the Suzuki et al coating composition was subjected to an RF (13.56 MHz) glow discharge in oxygen at a pressure of 0.5 to 0.6 Torr at 200 watts for 5 minutes. Once again, the optical element resulting from this process had an anti-reflective surface.

EXAMPLE 4

A Suzuki et al coated optical element was subjected to the same RF glow discharge as in Example 3 except that the RF glow discharge treatment was performed in a nitrogen atmosphere instead of an oxygen atmosphere. The resulting optical element was found not to have an anti-reflective surface.

EXAMPLE 5

A Suzuki et al coated optical element was subjected to the same RF glow discharge as in Example 3 except that the RF glow discharge treatment took place in air as opposed to in oxygen. The resulting optical element had a surface that was both anti-reflective and anti-static.

EXAMPLE 6

A Suzuki et al coated optical element was subjected to an RF glow discharge as described in Example 3 except that the RF glow discharge took place in $O_2+CF_4$ instead of oxygen. The resulting optical element had an anti-reflective surface.

EXAMPLE 7

An optical element coated with the Clark coating composition was subjected to the same RF glow discharge as in Example 3. The resulting optical element did not have an anti-reflective surface.

EXAMPLE 8

A Clark coated optical element was subjected to the same RF glow discharge as in Example 4. The resulting optical element did not have an anti-reflective surface.

EXAMPLE 9

A Clark coated optical elements was subjected to the same RF glow discharge as in Example 5. The resultiing optical element had neither an anti-reflective nor an anti-static surface.

EXAMPLE 10

An optical element coated with the Suzuki et al coating composition was subjected to an AC (60 Hz) glow discharge in air at a pressure of 1 mm Hg, and at a current of 25 mA for 10 minutes. The optical element resulting from this process had an anti-static surface.

EXAMPLE 11

A Clark coated optical element was subjected to the same AC glow discharge as in Example 10. The optical element resulting from this process had an anti-static surface.

Although this invention has been described with reference to its preferred embodiment other embodiments can achieve the same results. Variations and modifications of the present invention will be obvious to those skilled in the art and it is intended to cover in the appended claims all such modifications and equivalents as follow in the true spirit and scope of this invention.

We claim:

1. A method of imparting anti-static properties to a plastic optical element comprising:

(a) overcoating at least one surface of an organic polymeric plastic substrate with a protective organo-silica coating wherein said coating comprises a dispersion of colloidal silica in a lower aliphatic alcohol-water solution, said alcohol-water solution consisting of the partial condensate of a silanol of the formula $RSi(OH)_3$ in which R is selected from the group of alkyl radicals of 1 to 3 inclusive carbon atoms, the vinyl radical, the 3,3,3-trifluoropropyl radical, the gamma-glycidoxypropyl radical and the gamma-methacryloxypropyl radical, at least 70 weight percent of the silanol being $CH_3Si(OH)_3$, said dispersion containing 10 to 50 weight percent solids consisting essentially of 10 to 70 weight percent colloidal silica, 30 to 90 weight percent of the partial condensate, and sufficient acid to provide a pH in the range of 3.0 to 6.0;

(b) exposing said organo-silica coated plastic substrate to a vacuum glow discharge.

2. The method of claim 1 wherein the plastic substrate is transparent.

3. The method of claim 1 wherein the plastic substrate comprises polycarbonate.

4. The method of claim 3 wherein the plastic substrate comprises poly(2,2'-dihydroxyphenylpropane)-carbonate.

5. The method of claim 1 wherein the plastic substrate comprises polydiethylene glycol bis(allyl carbonate).

6. The method of claim 1 wherein the plastic substrate comprises polymethyl methacrylate.

7. The method of claim 1 wherein the coated plastic substrate is exposed to a DC vacuum glow discharge.

8. The method of claim 1 wherein the caoted plastic substrate is exposed to an AC vacuum glow discharge.

9. The method of claim 1 wherein the coated plastic substrate is exposed to an RF vacuum glow discharge.

10. The method of claim 1 wherein the vacuum glow discharge is performed in an $O_2$ atmosphere.

11. The method of claim 1 wherein the vacuum glow discharge is performed in air.

12. The method of claim 1 wherein the vacuum glow discharge is performed in a nitrogen atmosphere.

13. The method of claim 1 wherein the vacuum glow discharge is performed in an $O_2+CF_4$ atmosphere.

14. The method of claim 1 wherein the optical element comprises an ophthalmic lens.

15. A method of producing an anti-static, anti-reflective optical element comprising:

(a) overcoating at least one surface of an organic polymeric plastic substrate with an organo-silica coating comprising components A, B, C and D wherein Component A is a hydrolysate of a silane compound containing an epoxy group and not less than two alkoxy groups which are directly bonded to an Si atom in the molecule;

Component B comprises fine particles of silica which particles have an average diameter of about 1 to 100 mu, and wherein Component C comprises an aluminum chelate compound having the formula $AlX_nY_{3-n}$ wherein X is OL (wherein L is a lower alkyl group), Y is at least one ligand produced from the group consisting of:

(1)$M^1COCH_2COM^2$ and (2)$M^3COCH_2COOM^4$ wherein ($M^1$, $M^2$, $M^3$ and $M^4$ are lower alkyl groups) and n is 0, 1 or 2; and wherein Component D comprises a solvent comprising more than about 1 weight percent water, the amount of Component B being about 1 to 500 parts by weight per 100 parts by weight of Component A, and the amount of Component C being about 0.01 to 50 parts by weight per 100 parts by weight of Component A; and (b) exposing said organo-silica coated plastic substrate to a vacuum glow discharge.

16. The method of claim 15 wherein the plastic substrate is transparent.

17. The method of claim 15 wherein the plastic substrate comprises polycarbonate.

18. The method of claim 17 wherein the plastic substrate comprises poly(2,2'-dihydroxyphenylpropane)-carbonate.

19. The method of claim 15 wherein the plastic substrate comprises polydiethylene glycol bis(allyl carbonate).

20. The method of claim 15 where the plastic substrate comprises polymethyl methacrylate.

21. The method of claim 15 wherein the vacuum glow discharge is performed in an $O_2$ atmosphere.

22. The method of claim 15 wherein the vacuum glow discharge is performed in air.

23. The method of claim 15 wherein the vacuum glow discharge is performed in an $O_2+CF_4$ atmosphere.

24. The method of claim 15 wherein the optical element comprises an ophthalmic lens.

25. The method of claim 15 wherein the coated plastic substrate is exposed to an AC vacuum glow discharge.

26. The method of claim 15 wherein the coated plastic substrate is exposed to a DC vacuum glow discharge.

27. The method of claim 15 wherein the coated plastic substrate is exposed to an RF vacuum glow discharge.

28. The method of claim 15 wherein the vacuum glow discharge is performed in a nitrogen atmosphere.

* * * * *